United States Patent [19]

Yano

[11] 4,087,171

[45] May 2, 1978

[54] ELECTROPHOTOGRAPHIC EXPOSURE AND DEVELOPMENT SYSTEM

[75] Inventor: Takashi Yano, Tokyo, Japan

[73] Assignee: Ricoh Co., Ltd., Tokyo, Japan

[21] Appl. No.: 624,207

[22] Filed: Oct. 20, 1975

[30] Foreign Application Priority Data

Oct. 21, 1974 Japan ..... 49/121120

[51] Int. Cl.[2] ..... G03G 15/00

[52] U.S. Cl. ..... 355/14; 355/10

[58] Field of Search ..... 355/3 DD, 10, 14, 67-69, 355/71, 83; 96/1 R, 1 LY, 1 SD

[56] References Cited

U.S. PATENT DOCUMENTS

| | | | |
|---|---|---|---|
| 2,956,487 | 10/1960 | Giaimo | 355/14 |
| 3,732,003 | 5/1973 | Altmann | 355/14 |
| 3,892,481 | 7/1975 | Schaefer et al. | 355/10 |

*Primary Examiner*—William M. Shoop
*Attorney, Agent, or Firm*—Frank J. Jordan

[57] ABSTRACT

Imaging means are provided to radiate a light image of an original document onto a photoconductive drum to produce an electrostatic image. A developing electrode is disposed adjacent to the drum and voltage source means apply a biasing voltage to the developing electrode. Sensing means sense the electrostatic potential of a background area of the electrostatic image and control the voltage source means in accordance therewith. Limiting means limit the biasing voltage to one of a first upper limit or a higher second upper limit. In order to improve the reproduction of low contrast documents, the exposure intensity is reduced to a value at which the difference in brightness of the light and dark areas of the document will produce a maximum difference in electrostatic potential on the drum. For normal documents, the biasing voltage is limited to the first upper limit. For low contrast, low density documents, the biasing voltage is limited to the second upper limit to prevent darkening of the light areas of the copy. For documents having low contrast and large dark areas, the biasing voltage is limited to the first upper limit so that the dark areas will be reproduced with high density.

22 Claims, 5 Drawing Figures

ELECTROPHOTOGRAPHIC EXPOSURE AND DEVELOPMENT SYSTEM

The present invention relates to a method and apparatus for electrophotography for improving the contrast of copies of low contrast original documents.

In the art of electrophotography, original documents having low density and contrast, such as those made by the diazo process, are extremely difficult to reproduce. Low density means that even the dark areas of the document are rather light and low contrast means that the difference between the dark areas and light areas is small. It has further been difficult to reproduce documents having low contrast and large dark areas or high density.

The prior art includes methods such as cascade development, neutral toner polarization and utilization of edge effects to overcome this problem. Although these methods are sometimes satisfactory for line documents, they are not suitable for the reproduction of gray scales.

A recourse is known to reduce the brightness of illumination of the imaging light source in order to increase the contrast of the reproduction. This, however, results in a darkening of the light or background areas of the copy.

It is also known in the art to reduce the voltage applied to a developing electrode in order to make a low density image visible in the copy. This method does not increase the contrast of the copy and also results in darkening of the background area.

It is therefore an object of the present invention to provide a method of increasing the contrast of an electrophotographic reproduction of a low density and contrast document without darkening the background areas.

It is a further object of the invention to provide a method of satisfactorily reproducing a document having low contrast and large dark areas.

It is a further object of the present invention to provide electrophotographic apparatus embodying the methods.

The above and other objects, features and advantages of the present invention will become clear from the following detailed description taken with the accompanying drawings, in which.

Figure 1:
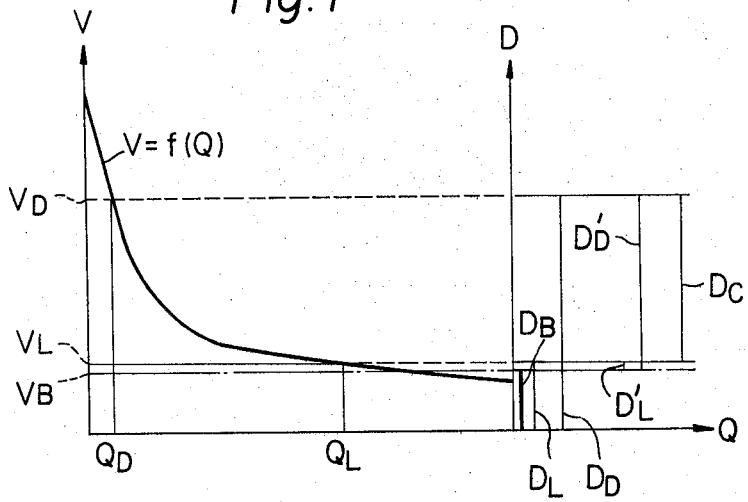
FIG. 1 is a graph illustrating a method of electrostatically copying a normal contrast document.

Referring now to FIG. 1, the process of electrostatically copying an original document having normal contrast is graphically illustrated. The abscissa axis is linearly graduated and represents the intensity of illumination Q of a light image of an original document incident on a photoconductive member such as a drum. The left ordinate axis is linearly graduated and represents the voltage V remaining on the drum after exposure to light of intensity Q for a predetermined length of time. The right ordinate axis represents the density of the image produced on a copy sheet which corresponds to the voltage V. A curve $V = f(Q)$ represents the photoconductivity characteristic of the photoconductive drum.

The intensity of light from the background or light areas of the document is represented by $Q_L$ whereas the intensity of light from the darkest areas of the document is represented by $Q_D$. The drum is charged before exposure, and the charge is dissipated by photoconductivity upon exposure to the light image of the document in such a manner that the remaining voltage or potential on the drum in the light and dark areas of the image is $V_L$ and $V_D$ respectively. The voltages correspond to densities on the copy of $D_L$ and $D_D$ respectively.

The method utilizes a developing electrode or counter electrode disposed adjacent to the drum which is biased to a voltage $V_B$ which corresponds to a density $D_B$ which is slightly lower than the density $D_L$ of the background areas so that toner particles will be attracted to the developing electrode rather than to the background areas of the electrostatic image on the drum. By this means, the densities of the light and dark areas on the copy become $D_L'$ and $D_D'$ which are equal to $(D_L-D_B)$ and $(D_D-D_B)$ respectively. The contrast range of the copy is thereby $D_C$ which is equal to $(V_D-V_L)$.

Figure 2:
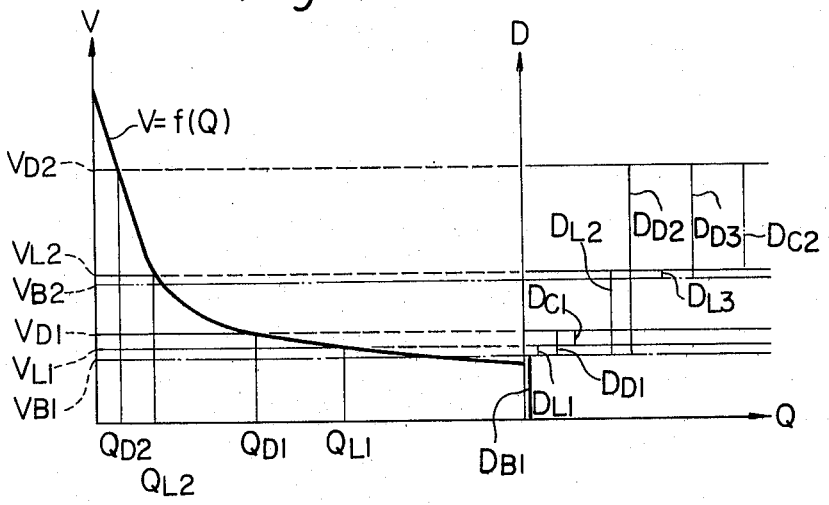
FIG. 2 is a graph illustrating a method of copying a low contrast document.

Referring now to FIG. 2, the electrophotographic method is illustrated for a low contrast original. The intensity of the light areas $Q_{L1}$ is the same as the intensity $Q_L$ of the normal contrast document. However, the intensity of the darkest areas $Q_{D1}$ is higher than the intensity $Q_D$ for the normal contrast document. With a biasing voltage $V_{B1}$ which is equal to $V_B$ corresponding to a density $D_{B1}$, the voltage $V_{L1}$ and density $D_{L1}$ of the light areas will be equal to the voltage $V_L$ and density $D_L'$ respectively. However, the voltage $V_{D1}$ and density $D_{D1}$ of the dark areas will be considerable less than the voltage $V_D$ and density $D_D'$ respectively. The contrast $D_{C1}$ which is equal to $(D_{D1}-D_{L1})$ is much less than the contrast $D_C$ of the normal contrast document.

Examination of the curve $V = f(Q)$ will disclose that the slope thereof is greater near the V axis than near the D axis. This fact is utilized to increase the contrast of the copy. Specifically, the intensity of the entire light image is uniformly reduced so that the intensity of the dark areas $Q_{D2}$ is equal to the intensity $Q_D$ of the normal contrast document. The intensity of the light areas then has a value $Q_{L2}$. The corresponding voltages on the drum are $V_{D2}$ and $V_{L2}$ respectively.

The densities corresponding to the voltages $V_{D2}$ and $V_{L2}$ and $D_{D2}$ and $D_{L2}$ respectively, which produce a contrast $D_{C2}$ which is much greater than the contrast $D_{C1}$. It will be understood that since the intensities $Q_{L2}$ and $Q_{D2}$ correspond to a region of steep slope of the curve $V = f(Q)$, a given difference in intensities will produce a greater difference in voltages on the drum than in the region near the D axis. In this manner, the contrast of the copy is increased by decreasing the intensity of the light image incident on the photoconductive drum.

It will be seen that the density $D_{D2}$ is equal to the density $D_D'$ of the normal contrast document. It will also be noticed that the density $D_{L2}$ is greater than the density $D_L'$ of the normal contrast document by which the background areas of the copy will be undesirably darkened. This effect is eliminated by increasing the biasing voltage on the developing electrode to a value $V_{B2'}$ which reduces the densities of the light and dark areas to $D_{L3}$ and $D_{D3}$ respectively. The density $D_{L3}$ is made equal to the density $D_L'$ through suitable selection of the voltage $V_{B2}$, and the contrast is maintained at the same value $D_{C2}$. The overall result is that the contrast is increased without undesirably darkening the background areas of the copy. It will be understood that the biasing voltage $B_{B2}$ may be made equal to the voltage $V_{L2}$ if desired to further reduce the possibility of a darkened background.

The idea of the invention comprises selecting the intensity of the light image in such a manner that a given intensity difference in the light image will produce a maximum voltage difference on the photoconductive drum.

In my copending application Ser. No. 594,181 filed July 8, 1975, I disclose a developing electrode which is self-biased by proximity to a photoconductive drum. Voltage regulator means are switchable to provide a low biasing voltage for normal contrast originals and a high biasing voltage for low contrast originals. In the present disclosure I teach a method of biasing the developing electrode from a voltage source means, the biasing voltage being a function of a sensed electrostatic potential on the drum and being limited to a first upper limit for normal contrast and density documents and documents with low contrast and large dark areas. The biasing voltage is limited to a higher second upper limit for low contrast, low density documents. The present system provides even finer control of the electrophotographic process since the developing electrode biasing voltage is controlled to the optimum value as a predetermined function of the sensed electrostatic potential on the drum in a range below the first or second upper limit.

Figure 3:
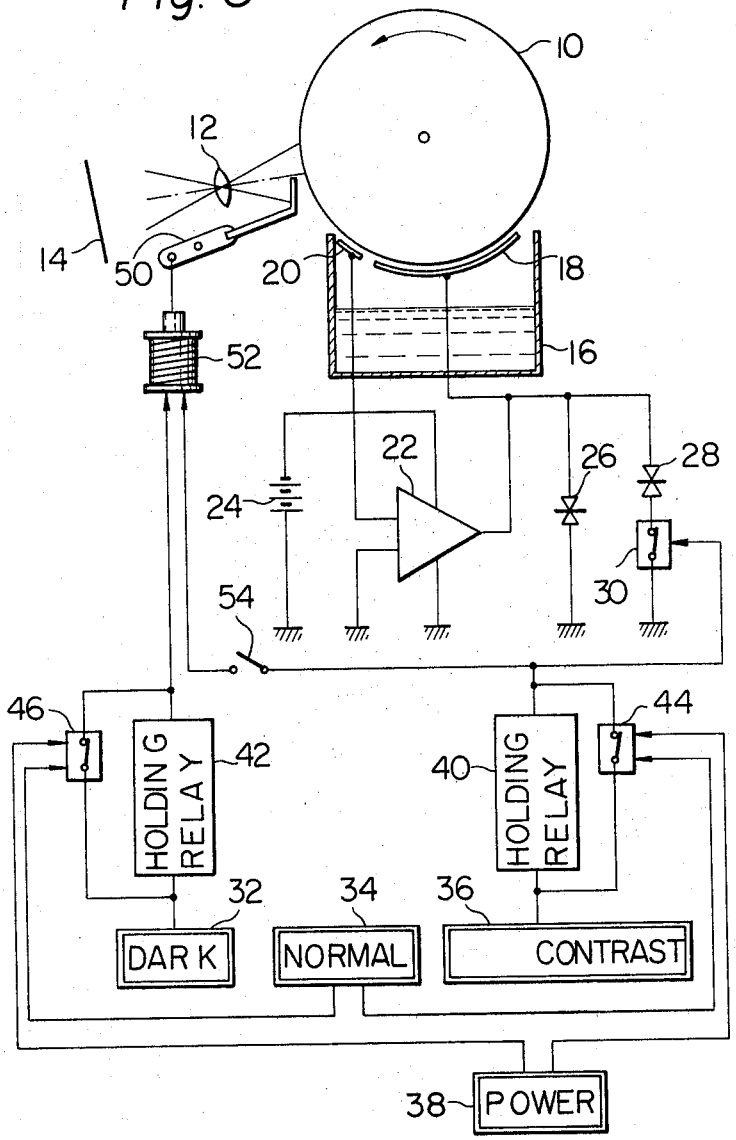
FIG. 3 is a schematic drawing of electrophotographic apparatus embodying the present invention.

Referring now to FIG. 3, a first embodiment of the invention comprises a photoconductive drum 10 which is rotatable as shown by an arrow. An imaging means comprises a lens 12 to project an image of an original document 14 onto the drum 10. Charging means which are not shown charge the drum 10 prior to imaging in a conventional manner.

A developer tank 16 is adapted to be filled with a liquid developing solution comprising, for example, dark colored toner particles in suspension. A pump which is not shown pumps the developer liquid into a space between the drum 10 and a developing electrode 18. A sensing electrode 20 is provided adjacent to the drum 10 upstream of the developing electrode 18.

The sensing electrode 20 is connected to an input of voltage source means comprising an operational amplifier 22 which is powered by a battery 24. The output of the operational amplifier 22 is connected to the developing electrode 18. A zener diode 26 is connected between the developing electrode 18 and ground. Another zener diode 28 is connected between the developing electrode 18 and ground in series with normally closed relay contacts 30. The breakdown voltage of the zener diode 26 is higher that of the zener diode 28 so that the zener diodes 26 and 28 provide second and first upper limits for the output voltage of the operational amplifier 22 respectively which is applied to the developing electrode 18.

Four push button switches are provided which are designated as 32, 34, 36 and 38. The switch 38 is a power switch. The switch 34 is depressed to designate that the document 14 has normal contrast and density. The switch 36 is depressed to designate that the document 14 has low contrast and density. The switch 32 depressed to designate that the document 14 has low contrast and high density or large dark areas.

The normal switch 34 and power switch 38 are connected to control a holding relay 40 by means of a switch 44. The contrast switch 36 controls the holding relay 40 directly as will be described in detail below. The normal switch 34 and power switch 38 control a holding relay 42 through a switch 46. The dark switch 32 directly controls the holding relay 42.

A light valve or shutter 50 is normally held in position out of the path of the lens 12 and is movable by means of a solenoid 52 into a position to partially obstruct the light image projected by the lens 12 onto the drum 10. The solenoid 52 may be energized either by the holding relay 42 or by the holding relay 40 through normally open relay contacts 54. The holding relay 40 is connected to control the relay contacts 30 and 54.

The holding relays 40 and 42 and switches 44 and 46 are arranged in such a manner that the holding relay 40 is energized when the low contrast switch 36 is depressed and de-energized when the normal switch 34 is depressed or the power switch 38 is opened. The holding relay 42 is energized when the dark switch 32 is depressed and deenergized when the normal switch 34 is depressed or when the power switch 38 is opened.

In operation, the drum 10 is charged by the charging unit (not shown), imaged by the lens 12 to form an electrostatic image of the document 14 thereon, developed by the developer liquid utilizing the developing electrode 18 and pressed in contact with a copy sheet (not shown). The toner image formed by the developer liquid is transferred to the copy sheet and thermally fixed thereto by transfer and fixing means which are not shown.

To copy a normal document 14, the apparatus operator depresses the power switch 38 to turn on the apparatus and depresses the normal switch 34 to de-energize the holding relays 40 and 42. As a result, the contacts 54 are open so that the solenoid 52 is de-energized. The shutter 50 is therefore out of the path of the lens 12. The contacts 30 are closed so that the developing electrode biasing voltage is limited to the first (lower) upper limit by the zener diode 28 in the manner described with reference to FIG. 1. The sensing electrode 20 is arranged to sense the electrostatic potential of the background areas of the electrostatic image on the drum 10 and apply a voltage to the operational amplifier 22 in accordance therewith. The output of the operational amplifier 22 is a predetermined function of the sensed electrostatic potential so that the biasing voltage applied to the developing electrode 18 has an optimum value in accordance with the principles of FIGS. 1 and 2. If the output of the operational amplifier 22 exceeds the breakdown voltage of the zener diode 28 (the first upper limit), the zener diode 28 conducts to limit the voltage applied to the developing electrode 18 to the first upper limit. In this manner, the optimum imaging light intensity and biasing voltage are provided for the drum 10 for a normal document 14.

For a document 14 with low contrast and density, the apparatus operator depresses the contrast switch 36 which energizes the holding relay 40 so as to open the contacts 30 and close the contacts 54. Opening of the contacts 30 disconnects the zener diode 28 from the developing electrode 18 so that the output voltage of the operational amplifier 22 is limited to the second (higher) upper limit by the zener diode 26. Closing of the contacts 54 energizes the solenoid 52 so that the shutter 50 is moved to partially obstruct the lens 12. As a result, the imaging light intensity is reduced to increase the contrast of reproduction and the biasing voltage is increased to prevent darkening of the background areas as discussed with reference to FIGS. 1 and 2.

To reproduce a document 14 having low contrast and high density or large dark areas, the apparatus operator depresses the dark switch 32 to energize the holding relay 42. This energizes the solenoid 52 to decrease the imaging light intensity and thereby increase the reproduction contrast but does not increase the upper limit of the biasing voltage applied to the developing electrode 18. In this manner, the dark areas of the document 14 are reproduced with adequate density.

If the contrast switch 36 was depressed to energize the holding relay 40 and it is desired to reproduce a dark document 14, the operator depresses the normal switch 34 to de-energize the holding relay 40 and then depresses the dark switch 32 to energize the holding relay 42. The normal switch 34 may similarly be depressed to de-energize the holding relay 42 prior to depressing the contrast switch 36.

Figure 5:
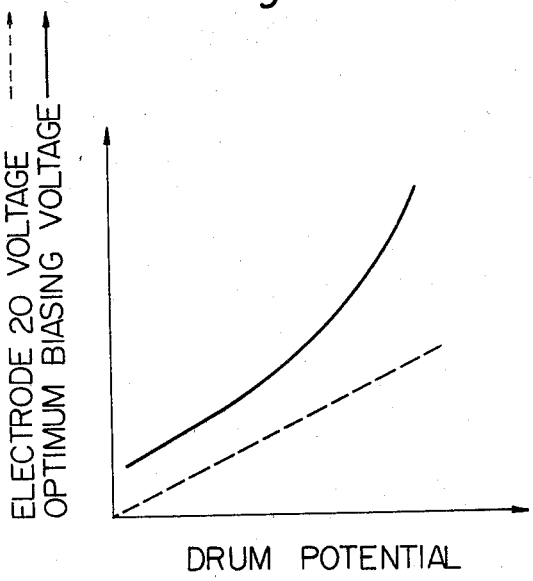
FIG. 5 is a graph illustrating a developing electrode biasing voltage as a function of sensed electrostatic potential on a photoconductive drum.

In the reproduction of low contrast and density documents, it is often desirable to provide the developing electrode 18 biasing voltage as a non-linear function of the background potential of the drum 10. This is illustrated in FIG. 5 in which a solid line curve represents the optimum biasing voltage and a broken line curve represents the sensing electrode 20 voltage as a function of the background potential of the electrostatic image on the drum 10.

Figure 4:
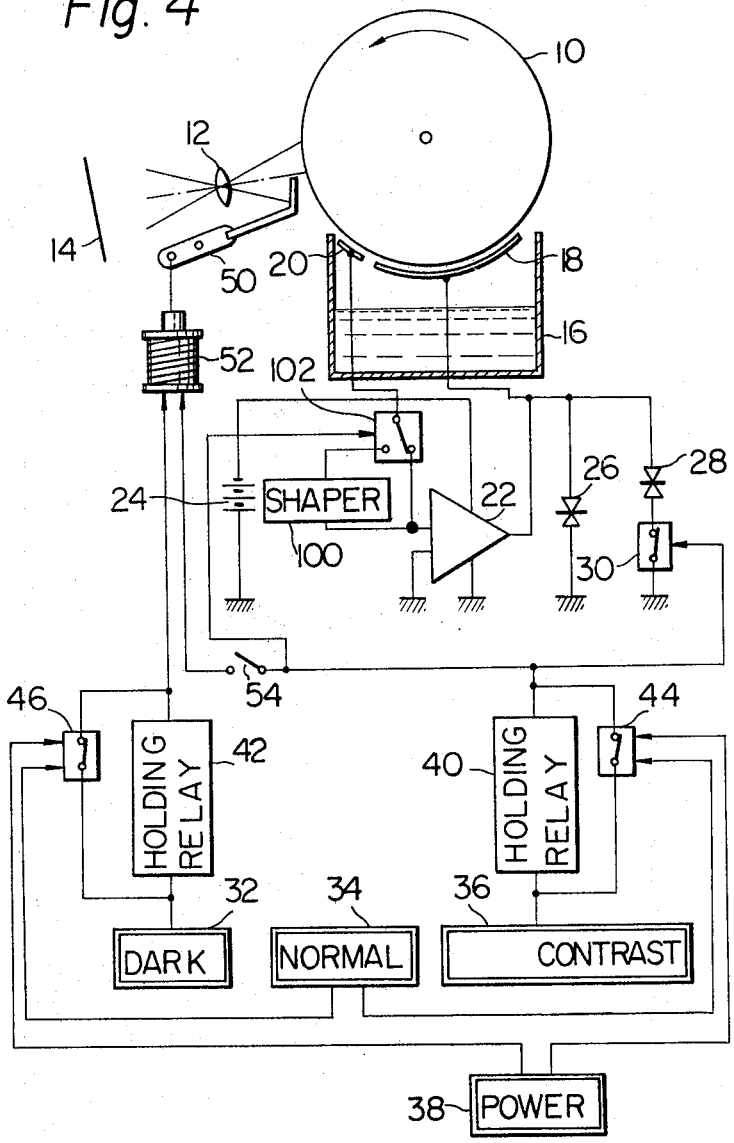
FIG. 4 is similar to FIG. 3 but shows a modified embodiment.

The embodiment of FIG. 4 is similar to that of FIG. 4 and identical components are represented by the same reference numerals. In FIG. 4, relay contacts 102 are connected between the sensing electrode 20 and the input of the operational amplifier 22 which are actuated by the holding relay 40. When the holding relay 40 is de-energized, the sensing electrode 20 is connected directly to the input of the operational amplifier 22. When the holding relay 40 is energized by depressing the low contrast switch 36, the sensing electrode 20 is connected to the input of the operational amplifier 22 through a shaper 100 which provides the non-linear function shown in FIG. 5. It will thus be recognized that the nonlinear function is provided only for low contrast and density documents 14.

With the developing electrode 18 voltage is held at the second (higher) upper limit for a prolonged period of time, a problem may arise of excessive amounts of toner particles accumulating on the developing electrode 18 which may be hard to remove. In this case, a light bulb may be provided to indicate that the developing electrode 18 voltage is at the second upper limit or a timer may be provided to reduce the developing electrode 18 voltage after a predetermined length of time (not shown).

Many modifications will become possible for those skilled in the art within the scope of the present invention after receiving the teachings of the present disclosure.

What is claimed is:

1. An electrophotographic method utilizing a developing electrode to develop an electrostatic image formed on a photoconductive member, comprising the steps of:

(a) radiating at one of a first predetermined intensity and second predetermined intensity a light image of an original document onto the photoconductive member to form the electrostatic image, the second predetermined intensity being lower than the first predetermined intensity;

(b) sensing an electrostatic potential of a background area of the electrostatic image;

(c) applying a biasing voltage to the developing electrode in accordance with the sensed electrostatic potential; and (d) limiting the biasing voltage to one of a first upper limit and a second upper limit which is higher than the first upper limit, both the one of the first and second predetermined intensities and the one of the first and second upper limits being selected to copy the original document depending upon contrast and density of the original document being copied.

2. A method of claim 1, in which the light image of the original document is radiated onto the photoconductive member at the first predetermined intensity and the biasing voltage is limited to the first upper limit for an original document having normal contrast and density.

3. A method of claim 2, in which the biasing voltage is applied to the developing electrode as a predetermined function of the sensed electrostatic potential.

4. A method of claim 1, in which the light image of the original document is radiated onto the photoconductive member at the second predetermined intensity and the biasing voltage is limited to the second upper limit for an original document having low contrast and density.

5. A method of claim 4, in which the biasing voltage is applied to the developing electrode as a predetermined function of the sensed electrostatic potential.

6. A method of claim 1, in which the light image of the original document is radiated onto the photoconductive member at the second predetermined intensity and the biasing voltage is limited to the first upper limit for an original document having low contrast and large dark areas.

7. A method of claim 6, in which the biasing voltage is applied to the developing electrode as a first predetermined function of the sensed electrostatic potential.

8. An electrophotographic method utilizing a developing electrode to develop an electrostatic image formed on a photoconductive member, comprising the steps of: for an original document having normal contrast and density:

(a) radiating a light image of the original document onto the photoconductive member to form the electrostatic image, the light image having a first predetermined intensity;

(b) sensing an electrostatic potential of a background area of the electrostatic image;

(c) applying a biasing voltage to the developing electrode as a first predetermined function of the sensed electrostatic potential; and (d) limiting the biasing voltage to a first upper limit, for an original document having low contrast and density:

(e) radiating a light image of the original document onto the photoconductive member to form the electrostatic image, the light image having a second predetermined intensity which is lower than the first predetermined intensity;

(f) sensing an electrostatic potential of a background area of the electrostatic image;

(g) applying a biasing voltage to the developing electrode as a second predetermined function of the sensed electrostatic potential; and (h) limiting the biasing voltage to a second upper limit which is higher than the first upper limit; and for an original document having low contrast and large dark areas:

(i) radiating a light image of the original document onto the photoconductive member to form the electrostatic image, the light image having the second predetermined intensity;

(j) sensing an electrostatic potential of a background area of the electrostatic image;

(k) applying a biasing voltage to the developing electrode as the first predetermined function of the sensed electrostatic potential; and (l) limiting the biasing voltage to the first upper limit.

9. Electrophotographic apparatus comprising:

a photoconductive member;

a developing electrode disposed adjacent to the photoconductive member;

imaging means for radiating at one of a first predetermined intensity and a second predetermined intensity a light image of an original document onto the photoconductive member to form an electrostatic image thereon, the second predetermined intensity being lower than the first predetermined intensity;

sensing means for sensing an electrostatic potential of a background area of the electrostatic image;

voltage source means for applying a biasing voltage to the developing electrode in accordance with the sensed electrostatic potential; and limiting means for limiting the biasing voltage to one of a first upper limit and a second upper limit which is higher than the first upper limit, both the one of the first and second predetermined intensities and the one of the first and second upper limits being selected to copy the original document depending upon the contrast and density of the original document being copied.

10. The apparatus of claim 9, further comprising control means operative to control the limiting means to limit the biasing voltage to the first upper limit and to control the imaging means to radiate the light imgage onto the photoconductive member at the first predetermined intensity for an original document having normal contrast and density.

11. The apparatus of claim 10, in which the control means is further operative to control the limiting means to limit the biasing voltage to the second upper limit and to control the imaging means to radiate the light image onto the photoconductive member at the second predetermined intensity for an original document having low contrast and density.

12. The apparatus of claim 11, in which the control means is further operative to control the limiting means to limit the biasing voltage to the first upper limit and to control the imaging means to radiate the light image onto the photoconductive member at the second predetermined intensity for an original document having low contrast and large dark areas.

13. The apparatus of claim 12, in which the control means is further operative to control the voltage source means to apply the biasing voltage to the developing electrode as a first predetermined function of the sensed electrostatic potential for the document having normal contrast and density and for the document having low contrast and large dark areas and to apply the biasing voltage to the developing electrode as a second predetermined function of the sensed electrostatic potential for the document having low contrast and density.

14. Electrophotographic apparatus comprising:

a photoconductive member;

a developing electrode disposed adjacent to the photoconductive member;

imaging means for radiating a light image of a document onto the photoconductive member to form an electrostatic image thereon;

sensing means for sensing an electrostatic potential of a background area of the electrostatic image;

voltage source means for applying a biasing voltage to the developing electrode in accordance with the sensed electrostatic potential;

limiting means operative to limit the biasing voltage to one of a first upper limit and a second upper limit which is higher than the first upper limit; and control means operative to control the imaging means and the limiting means as follows: for a document having normal contrast and density the control means is operative to control the limiting means to limit the biasing voltage to the first upper limit and to control the imaging means to radiate the light image onto the photoconductive member at a first predetermined intensity, for a document having low contrast and density the control means is operative to control the limiting means to limit the biasing voltage to the second upper limit and to control the imaging means to radiate the light image onto the photoconductive member at a second predetermined intensity which is lower than the first predetermined intensity, and for a document having low contrast and large dark areas the control means is operative to control the limiting means to limit the biasing voltage to the first upper limit and to control the imaging means to radiate the light image onto the photoconductive member at the second predetermined intensity.

15. The apparatus of claim 14, in which the control means is further operative to control the voltage source means to apply the biasing voltage to the developing electrode as a first predetermined function of the sensed electrostatic potential for a document having normal contrast and density and for a document having low contrast and large dark areas and to apply the biasing voltage to the developing electrode as a second predetermined function of the sensed electrostatic potential for a document having low contrast and density.

16. The apparatus of claim 15, in which the second predetermined function is non-linear.

17. The apparatus of claim 14, in which the imaging means comprises light valve means movable by the control means from a first position to provide the first predetermined intensity to a second position to provide the second predetermined intensity.

18. The apparatus of claim 14, in which the voltage source means comprises a voltage amplifier.

19. The apparatus of claim 17, in which the control means comprises a solenoid for moving the light valve means.

20. The apparatus of claim 14, in which the limiting means comprises switch means for switching between the first and second predetermined upper limits.

21. The apparatus of claim 15, in which the voltage source means comprises switch means for switching between the first and second predetermined functions.

22. The apparatus of claim 14, in which the control means comprises switch means for manually designating one of a document having normal contrast and density, a document having low contrast and density and a document having low contrast and large dark areas.

* * * * *